US005087237A

United States Patent [19]

Nunley

[11] Patent Number: 5,087,237

[45] Date of Patent: Feb. 11, 1992

[54] ADJUSTABLE ROTARY WASTE REMOVAL SYSTEM FOR ROLLS OF DIE CUT PAPERBOARD

[76] Inventor: Forrest E. Nunley, 15240 Las Flores, La Mirada, Calif. 90638

[21] Appl. No.: 604,804

[22] Filed: Oct. 26, 1990

[51] Int. Cl.[5] ..... B31B 49/00

[52] U.S. Cl. ..... 493/342; 493/373; 493/472

[58] Field of Search ..... 493/342, 373, 472, 370, 493/371, 471, 474; 384/255

[56] References Cited

U.S. PATENT DOCUMENTS

| | | | |
|---|---|---|---|
| 2,711,935 | 6/1955 | Miles | 384/255 |
| 2,986,086 | 5/1961 | Siebke | 384/255 X |
| 3,320,864 | 5/1967 | Zernov | 493/373 |
| 3,359,843 | 12/1967 | Mead | 384/255 X |
| 3,371,584 | 3/1968 | Zernov | 493/373 |
| 3,467,450 | 10/1969 | Schmidt et al. | 384/255 X |
| 3,513,756 | 5/1970 | Schütz | 493/373 |
| 3,877,353 | 4/1975 | Smith et al. | 493/373 |
| 4,367,069 | 1/1983 | Bishop | 493/342 |
| 4,613,321 | 10/1986 | Kesten et al. | 493/342 |

*Primary Examiner*—Bruce M. Kisliuk
*Assistant Examiner*—John A. Marlott
*Attorney, Agent, or Firm*—Edgar W. Averill, Jr.

[57] ABSTRACT

An improved adjustable rotary waste removal apparatus for removing and ejecting pieces of paperboard cut from a web of paperboard. The apparatus includes a pair of rollers, one of the rollers supporting many stripper pins and the other roller being a backup or anvil roller which supports the paperboard as the stripper pin passes through it. As the roller holding the stripper pins continues to turn, an internal off-center roller causes an ejection sleeve to move upwardly and remove the waste paperboard from the stripper pin. The improvement of the present invention relates to the adjustable mounting of the internal roller which moves the ejection sleeve outwardly so that the size of the roller supporting the stripper pins can be easily and quickly changed.

7 Claims, 2 Drawing Sheets 10
11
12
12a
13
14
14a
16
17
18
19
20
21
22
23
24
25
26
27
30
8
9

10
11
12
20
24
25
26
27
28
28a
30

ADJUSTABLE ROTARY WASTE REMOVAL SYSTEM FOR ROLLS OF DIE CUT PAPERBOARD

BACKGROUND OF THE INVENTION

The field of the invention is paperboard die cutting, and the invention relates more particularly to the continuous waste removal from a previously die cut web of paper or paperboard.

A plurality of fixed pins are threaded into a rotary cylinder, and the pins penetrate waste material in a continuous web of paper or paperboard which is supported by an anvil roller. Thus, as a particular piece of waste from the web approaches the nib between the anvil roll and the rotary cylinder which supports the stripper pins, a stripper pin penetrates the waste which, in turn, is supported by the anvil roller and passes through the piece of waste and into a recess in the anvil roll which is usually a groove in the anvil roll. The pin, as it continues around the rotary pin cylinder, carries the piece of waste material until an ejection sleeve contacts an internal roller within the rotary pin cylinder, which internal roller forces the ejection sleeve outwardly, pushing the waste piece from the ejection pin and into a waste removal chute. As the pin continues around the rotary pin cylinder, the ejection sleeve is permitted to retract so that another piece of waste can be removed.

Other waste removal methods include a vacuum system wherein the die cut web passes over the mouth of a vacuum tunnel which draws the waste from the web. This system, however, requires essentially perfect die cutting so that the waste material will readily be drawn from the web. In practice, this requires rather frequent sharpening of the die cutting system so that the pieces are readily removed by vacuum. Furthermore, this system is quite ineffective for very small pieces of waste and likewise will not operate at a very high press speed.

For some continuous cutting systems, the waste can be contained in a continuous spool in which case the waste is simply rewound onto a spool. This system requires, however, that there be no internal pieces to be removed which are not connected to the waste web. This system also requires periodic shutdown to remove a full spool of waste web.

Another waste removal system also includes stripper pins, but rather than using ejection sleeves, a plurality of fixed combs are placed along the surface of the cylinder to comb the waste parts from the stripper pins. One difficulty with this system is the tendency of the combs to be compacted with fibers often leading to the breaking of the stripper pins. It is also an expensive system to set up and maintain.

For most high speed applications then, the use of the stripper pins in combination with ejection sleeves is most desirable. A major disadvantage with such system, however, occurs when the web repeat length is changed. This, in the past, has required a complete change of rotary pin cylinder and its internal eccentric cam sleeve which results in a substantial changeover cost every time the web repeat length is changed.

SUMMARY OF THE INVENTION

It is an object of the present invention to provide a stripper pin and ejection sleeve type of system which can be easily changed for different web repeat lengths.

The present invention is for an improved adjustable rotary waste removal apparatus for removing and ejecting pieces of paperboard cut from a web of paperboard of the type having a rotary pin cylinder holding a plurality of stripper pins. Each of the stripper pins has an ejection sleeve longitudinally movably mounted thereabout. The ejection sleeve is moved outwardly by contact with a cam sleeve mounted within the rotary pin cylinder. The rotary pin cylinder, in turn, is rotatably mounted adjacent an anvil roller having a plurality of recesses or grooves which are positioned adjacent each stripper pin thereby permitting each stripper pin to pass through a waste portion of a paperboard web and into the recess or groove of the anvil roller. This pierces the waste piece and holds it on the pin as the pin continues to rotate about the rotary pin cylinder. The improvement comprises a stub shaft and bearing mount for rotatably mounting the rotary pin cylinder and an eccentric bushing mounted on the stub shaft, which eccentric bushing supports a bearing which, in turn, rotatably supports the rotary pin cylinder. A cylindrical, eccentric cam sleeve is rotatably mounted on the stub shaft within the rotary pin cylinder whereby the diameter of the rotary pin cylinder (and thereby the repeat length) can be changed, and the internal eccentric cam sleeve can be moved to the position within the rotary pin cylinder so that it contacts and moves the ejection sleeve outwardly with respect to the stripper pin. Thus, it is only necessary to move the eccentric bushing and remove and replace the rotary pin cylinder with a rotary pin cylinder of the desired diameter greatly reducing the cost of rotary cylinder changeover.

DESCRIPTION OF THE PREFERRED EMBODIMENTS

Figure 1:
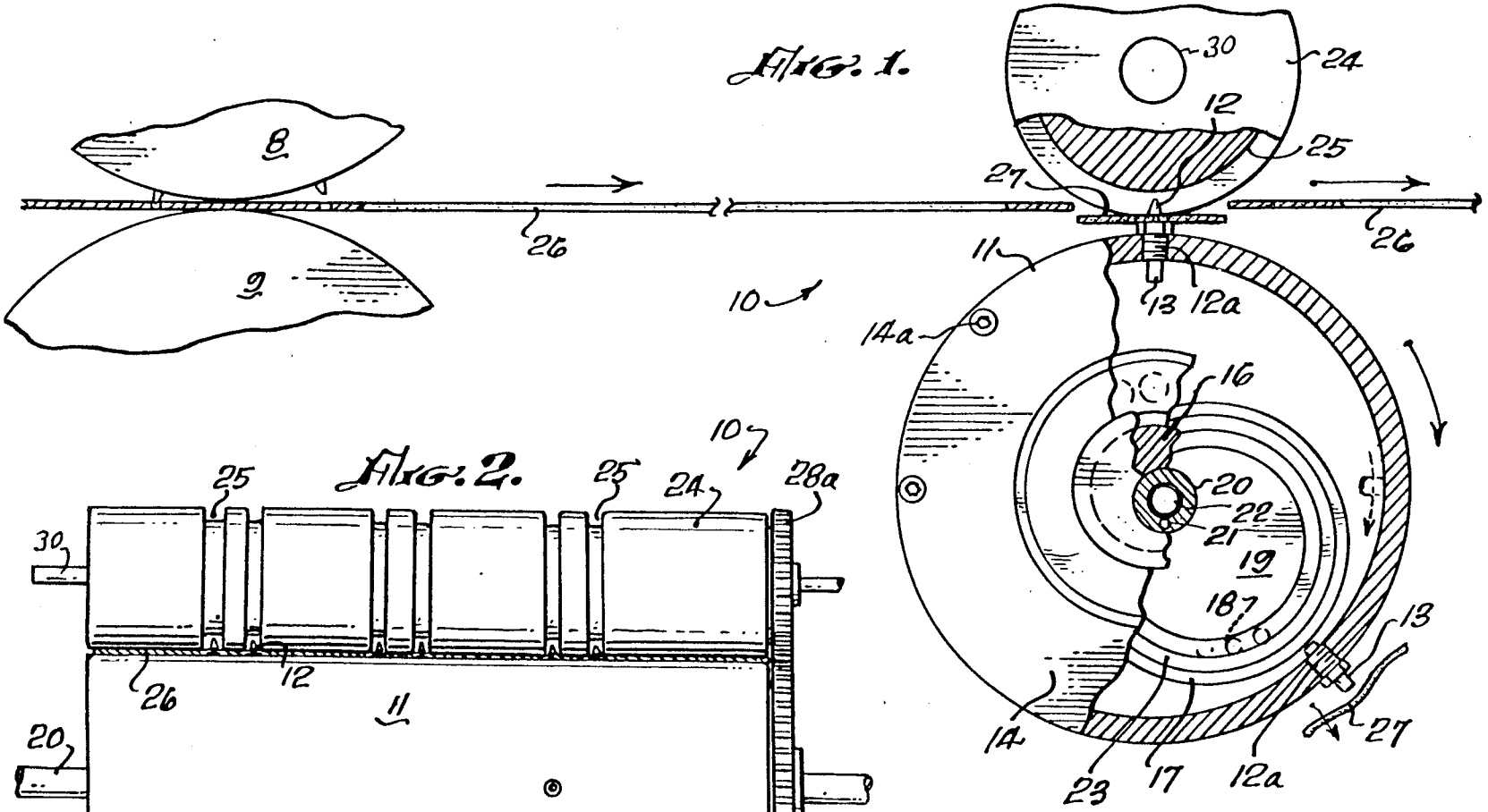
FIG. 1 is a side view, partly in cross-section, of the improved adjustable rotary waste removal system of the present invention.

The improved adjustable rotary waste removal apparatus of the present invention is shown in end view in FIG. 1 and indicated generally by reference character 10. Apparatus 10 includes a rotary pin cylinder 11 which supports a plurality of stripper pins 12. Each stripper pin is held to rotary pin cylinder 11 by a threaded pin sleeve and retainer 12*a*, and a roll pin, not shown, passes through the threaded pin sleeve and retainer 12*a* and holds an ejection sleeve 13 so that it can move from its withdrawn position at 12:00 o'clock in rotary pin cylinder 11 to an outward position shown at about 5:00 o'clock along rotary pin cylinder 11. Ejection sleeve 13 is moved outwardly by contact with an eccentric cam sleeve 17 which is rotatably mounted on cam shaft 19 by a plurality of roller bearings 18. Cam shaft 19 is held in a fixed position within rotary pin cylinder 11 by stub shaft 20 and has an axis of rotation 19*a*.

Figure 2:
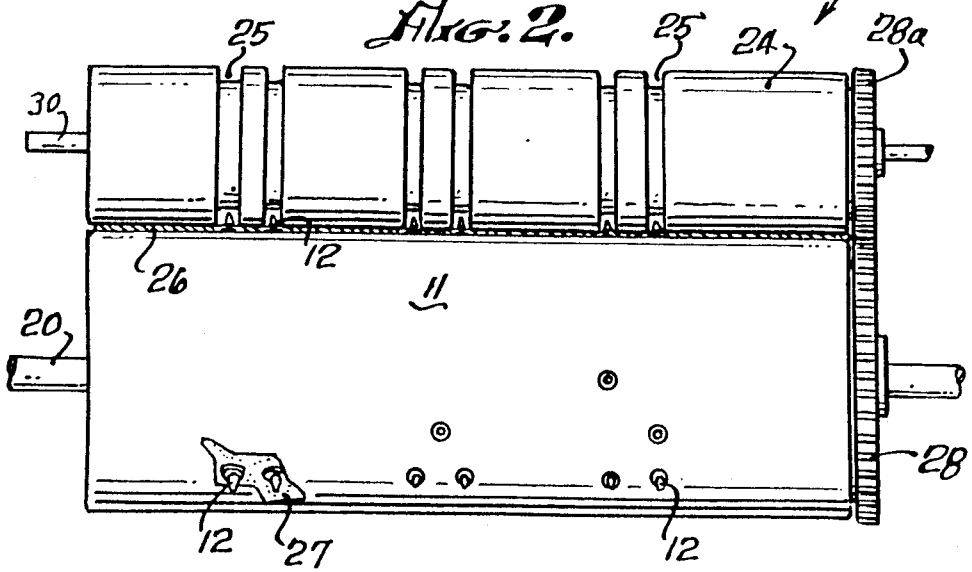
FIG. 2 is a front view thereof.

The continuous web of paperboard is indicated by reference character 26. Web 26 has been cut by passing between a rotary die cutter roll 8 which is backed up by base roll 9. A piece of waste, indicated by reference character 27, has been pierced by stripper pin 12 which passes within groove 25 of anvil roll 24. Anvil roll 24 is rotatably held on shaft 30, and a gear 28*a* is affixed to one end of anvil roll 24 as shown in FIG. 2. Gear 28*a* meshes with gear 28 which is fixed on rotary pin cylinder 11 also shown in FIG. 2.

As the piece of waste 27 is carried around rotary pin cylinder 11 to a position of about 5:00 o'clock, ejection sleeve 13 is moved outwardly by contact with freely rotatable eccentric cam sleeve 17, and the ejection sleeve thus pushes the waste 27 off of stripper pin 12 and into a waste chute not shown. It is evident that as stripper pin 12 continues to turn past the 5:00 o'clock position, the ejection sleeve 13 is permitted to retract fully to its position as shown at 12:00 o'clock.

Figure 4:
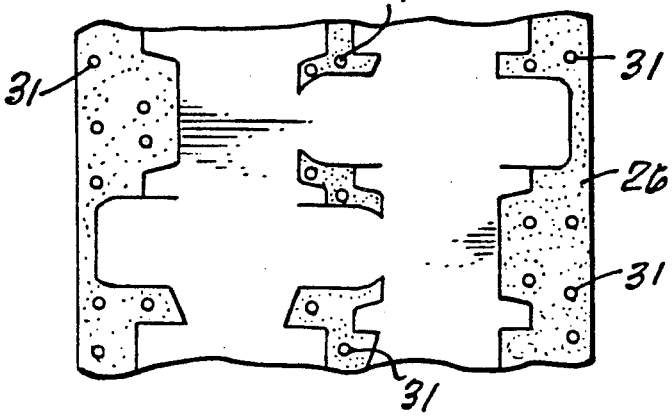
FIG. 4 is a plan view of a portion of a web showing the waste material which must be removed.

The end view of the anvil roller and the rotary pin cylinder 11, as shown in FIG. 2, is diagrammatic in that it shows an enlarged groove 25 on the left hand side of the anvil roll and an enlarged stripper pin 12 on the rotary pin cylinder. Actually, the grooves 25, as shown in the right hand side of the anvil roll, are smaller than that shown diagrammatically on the left hand side, and a plurality of stripper pins, as indicated by reference character 12 on the right hand side of the rotary pin cylinder 11, are positioned so that they pierce the web as shown by the dots 31 in the portion of the web 26 shown in FIG. 4.

Figure 3:
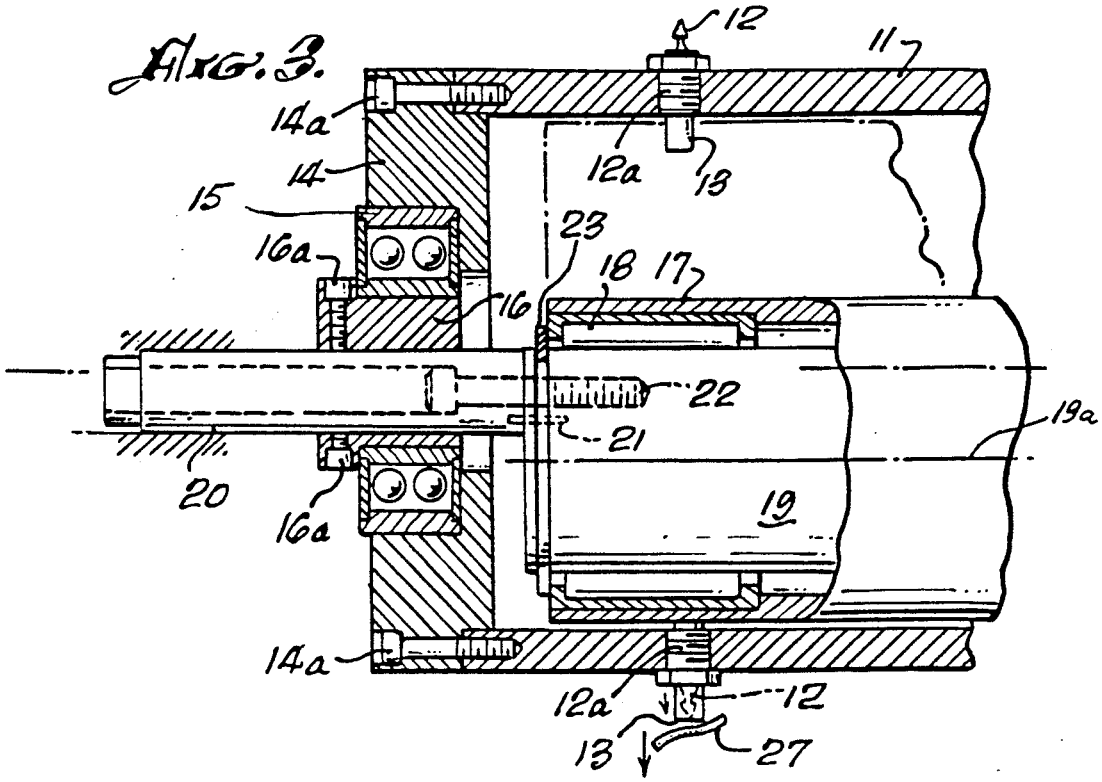
FIG. 3 is an enlarged cross-sectional front view of one end of the rotary pin cylinder of FIG. 1.
Figure 6:
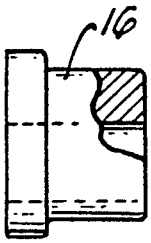
FIG. 6 is a side view of the eccentric bushing of FIG. 5.
Figure 5:
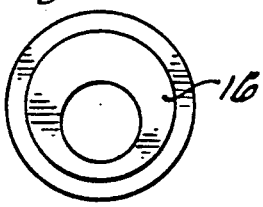
FIG. 5 is an end view of the eccentric bushing of the rotary pin cylinder of FIG. 1.

Every web has a repeat length wherein each box, or other unit, is repeated. When it is necessary to change to a different box, or other object, it is invariably necessary to change the rotary pin cylinder 11 so that its periphery matches some multiple of the repeat length. In the past, this has been a very expensive operation because it was necessary not only to change the rotary pin cylinder, but also the internal eccentric cam sleeve 17. With the design of the present invention, the rotary eccentric cam sleeve can be retained and only the outer rotary pin cylinder need by changed. As shown best in FIG. 3, rotary pin cylinder 11 is held to an end cap and bearing seat 14. This, in turn, holds rotary pin cylinder bearing 15 which is held on its inner surface by an eccentric bushing shown best in FIGS. 5 and 6 and shown in cross-sectional view in FIG. 3. To change the rotary pin cylinder 11, screws 14*a* are removed from, for instance, the left end of the rotary pin cylinder 11 as viewed in FIG. 2. On the right end, the eccentric bushing 16, which is a mirror image of that shown in FIG. 3, is loosened by loosening set screws 16*a*, and the right hand side of the unit is pulled away thereby removing rotary pin cylinder 11 and exposing the eccentric cam sleeve 17. Then, the larger or smaller rotary pin cylinder is replaced. In the event it is sized to match end cap 14, then the end cap 14 on the left hand side of the assembly need not be changed. The position of stub shaft 20 is adjusted so that the outer surface of the new rotary pin cylinder 11 matches the outer surface of anvil roller 24. Then the eccentric bushing 16 is turned after loosening set screws 16*a* so that the outer surface of eccentric cam sleeve 17 is at an appropriate spacing from the inner surface of rotary pin cylinder 11. It is not necessary to remove the eccentric cam sleeve 17. Typically, the gear 28 (shown in FIG. 2) would also be changed to match the outside diameter of rotary pin cylinder 11. Since eccentric cam sleeve 17 is freely rotatable on eccentric cam shaft 19 by way of roller bearings 18, there is no necessity of driving eccentric cam sleeve 17. Its contact with the inner end of ejection sleeves 13 will cause it to turn and prevent any unnecessary wear. As shown best in FIG. 3, the eccentric cam sleeve is held on the hardened eccentric cam shaft 19 by a lock ring 23. It is held to the stub shaft 20 at the end of the stub shaft by a bolt 22 and a lock pin 21 formed longitudinally in the end of hardened eccentric cam shaft 19. The stub shaft is separated from the axis of rotation 19*a* of camshaft 19.

While the eccentric bushing 16 provides a particularly easy method of moving the outside surface of eccentric cam sleeve 17, other refinements are also possible. For instance, several openings could be formed in the ends of eccentric cam shaft 19 to permit bolt 22 and lock pin 21 to be inserted at different locations. Another advantage of the present design results from the use of different diameters of anvil roll 24 and rotary pin cylinder 11. This results in the stripper pins 12 contacting the surface of anvil roll 24 at different points, thereby resulting in longer anvil roll life. It is typically not necessary to change the anvil roller when the rotary pin cylinder 11 is changed as long as the grooves in the anvil roller match the position of the stripper pins in the rotary pin cylinder 11.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved adjustable rotary waste removal apparatus for removing and ejecting pieces of paperboard cut from a web of paperboard of the type having a rotary pin cylinder holding a plurality of stripper pins, each of said stripper pins having an ejection sleeve longitudinally movably mounted thereabout, said ejection sleeve being moved outwardly into a stripping position by contact with a cam sleeve mounted within said rotary pin cylinder and said rotary pin cylinder being rotatably mounted adjacent an anvil roller having a plurality of recesses adjacent each stripper pin thereby permitting each stripper pin to pass through a waste portion of a paperboard web so as to remove said waste portion from said stripper pin by said ejection sleeve, wherein said improvement comprises;

a stub shaft and bearing mount for rotatably mounting said rotary pin cylinder;

an eccentric bushing mounted on said stub shaft, said eccentric bushing having an outer surface and an inner surface, said eccentric bushing supporting a bearing, said bearing rotatably supporting said rotary pin cylinder on the outer surface of the eccentric bushing; and a cylindrical eccentric cam sleeve having an axis of rotation, said eccentric cam sleeve being rotatably mounted on a hardened cam shaft which is held by said stub shaft at a position separated from said axis of rotation of the cam sleeve, said cam sleeve being within said rotatory pin cylinder.

2. The improved adjustable rotary waste removal apparatus of claim 1 wherein both the anvil roll and the rotary pin cylinder are synchronized in rotary movement by gear means affixed to said anvil roll and said rotary pin cylinder.

3. The improved adjustable rotary waste removal apparatus of claim 2 wherein the outside diameter of said anvil roll is different from said rotary pin cylinder.

4. An improved adjustable rotary waste removal apparatus for removing and ejecting pieces of paperboard cut from a web of paperboard of the type having a rotary pin cylinder holding a plurality of stripper pins, each of said stripper pins having an ejection sleeve longitudinally movably mounted thereabout, said ejection sleeve being moved outwardly into a stripping position by contact with a cam sleeve mounted within said rotary pin cylinder and said rotary pin cylinder being rotatably mounted adjacent an anvil roller having a plurality of recesses adjacent each stripper pin thereby permitting each stripper pin to pass through a waste portion of a paperboard web so as to remove said waste portion from said web and to hold said waste portion until removed from said stripper pin by said ejection sleeve, wherein said improvement comprises:

a stub shaft and bearing mount for rotatably mounting said rotary pin cylinder, said stub shaft supporting a mounting element for a hardened eccentric cam shaft;

said hardened eccentric cam shaft having an axis of rotation and having means for being held by the mounting element of said stub shaft at a position separated from the axis of rotation of the hardened eccentric cam shaft, said hardened eccentric cam shaft being mounted on said mounting element within said rotary pin cylinder; and a freely rotatable eccentric cam sleeve mounted on said hardened eccentric cam shaft held within said rotary pin cylinder by said stub shaft.

5. The improved adjustable rotary waste removal apparatus of claim 4 wherein said mounting element comprises a bolt threadable into said hardened eccentric cam shaft.

6. The improved adjustable rotary waste removal apparatus of claim 4 wherein said hardened eccentric cam shaft is fixed, and said eccentric cam sleeve is supported on said hardened eccentric cam shaft by roller bearings and a pair of lock rings at each end of said hardened eccentric cam.

7. The improved adjustable rotary waste removal apparatus of claim 4 wherein said rotary pin cylinder is supported by a pair of bearings which, in turn, are supported by a pair of eccentric bushings supported by a pair of stub shafts.

* * * * *